US010890340B1

(12) United States Patent
Bosa

(10) Patent No.: US 10,890,340 B1
(45) Date of Patent: Jan. 12, 2021

(54) CLAMP FOR MOUNTING A BRACKET AT AN OFFSET FROM A WALL, METHOD FOR MOUNTING A BRACKET ON A WALL AND METHOD FOR MOUNTING A COMPRESSOR ON A WALL

(71) Applicant: Rene Bosa, St-Georges de Beauce (CA)

(72) Inventor: Rene Bosa, St-Georges de Beauce (CA)

( * ) Notice: Subject to any disclaimer, the term of this patent is extended or adjusted under 35 U.S.C. 154(b) by 107 days.

(21) Appl. No.: 16/444,049

(22) Filed: Jun. 18, 2019

(51) Int. Cl.
*F24F 1/62* (2011.01)
*F24F 13/32* (2006.01)

(52) U.S. Cl.
CPC ..... *F24F 1/62* (2013.01); *F24F 13/32* (2013.01)

(58) Field of Classification Search
CPC ..... F24F 1/62; F24F 13/32; E04G 5/062
USPC ..... 248/675
See application file for complete search history.

(56) References Cited

U.S. PATENT DOCUMENTS

D266,827 S * 11/1982 Withrow ..... D18/59
8,628,050 B2 * 1/2014 Truckor ..... F16M 13/02 248/205.1
10,113,769 B2 * 10/2018 Crowley ..... E04G 5/062
2011/0073746 A1 * 3/2011 Padiotis ..... F24F 1/50 248/674

OTHER PUBLICATIONS

Ian Henman, Install of the Week May 22: Fujitsu RLS3 12,000 BTU Ductless Heat Pump, Sunshine Renewable Energy, May 22, 2015, retrieved from https://www.sunshinerenewables.ca/install-week-may-22-fujitsu-rls3-12000-btu-ductless-heat-pump/ on Jun. 7, 2019.

* cited by examiner

*Primary Examiner* — Bradley Duckworth
(74) *Attorney, Agent, or Firm* — BCF LLP

(57) ABSTRACT

A clamp comprises a lower section and an upper section. The lower section has a U-shaped cross-section forming a channel extending along a first axis. The channel has a flat bottom and two sides extending from the bottom along a second axis. Openings are formed in the bottom of the channel. The upper section has two elongate plates that extend from the two sides of the channel along the first axis. The elongate plates are offset along the second axis from the bottom of the channel. Apertures pierced along a third axis are distributed along the first axis on each of the elongate plates. Corresponding apertures pierced in the two elongate plates are coaxial with each other. Two clamps are anchored on a wall at their channels and two brackets are bolted to the clamps to support a compressor while providing clearance of the compressor from the wall.

16 Claims, 7 Drawing Sheets

CLAMP FOR MOUNTING A BRACKET AT AN OFFSET FROM A WALL, METHOD FOR MOUNTING A BRACKET ON A WALL AND METHOD FOR MOUNTING A COMPRESSOR ON A WALL

CROSS-REFERENCE

None.

TECHNICAL FIELD

The present disclosure relates to the field of mounting hardware. More specifically, the present disclosure relates to a clamp for mounting a bracket at an offset from a wall, a method for mounting a bracket on a wall and a method for mounting a compressor on a wall.

BACKGROUND

Residential heat pumps and air conditioning units are increasingly popular, at least in part owing to global warming and to the high cost of electricity required for home heating in many locations.

In virtually all air-source heat pumps and air conditioning units, a compressor is installed externally and is connected via conduits to an internal condenser, which is usually installed in a furnace having a ventilating motor for distributing heated or cooled air through air ducks. The compressor is thus exposed to elements, including rain, snow and sometimes ice. In areas where snow and ice may accumulate on the ground, the usual practice when installing heat pumps and air conditioning units for residential use is to mount the compressor on angular brackets that are fixed on a wall so that the compressor is in an elevated position above the ground. FIG. 1 (prior art) is a perspective view of a pair of conventional angular brackets that can be attached to a solid structure. Each angular bracket 10 includes a vertical member 12 having apertures 14 adapted for attaching the angular bracket 10 to a mounting surface, for example the concrete foundation of a house, using concrete anchors (not shown). Each angular bracket 10 also includes a horizontal member 16. A compressor (shown on later Figures) may be supported by horizontal members 16 of a pair of proximally installed angular brackets 10. An angled brace 18 connects the horizontal member 16 to the vertical member 12 for transferring the weight of the compressor toward the concrete foundation, preventing folding of the angular bracket 10 at a junction 20 between the horizontal member 16 and the vertical member 12. The vertical member 12, the horizontal member 18 and the angled brace 18 are mechanically connected via bolts 22 or using other mechanical means, without the need for welding the various members together. The angular bracket 10 is very generic and can be used to support compressors in a wide range of sizes and weights. The angular bracket 10, which is usually made of aluminum, is simple, produced in large quantities and is therefore very inexpensive.

Other angular bracket models are commonly used. For example, FIG. 2 (prior art) is a perspective view of a heat pump compressor supported by a pair of angular brackets. On FIG. 2, angular brackets 24 are slightly different from the angular brackets 10 of FIG. 1 in that they have different respective proportions between a horizontal member 26, a vertical member 28 and an angled member 30, and in that a junction 32 between the horizontal member 26 and the vertical member 28 does not comprise any bolt. Regardless, the angular brackets 24 share many commonalities with the angular brackets 10, including the fact that they are generic and very inexpensive. The angular brackets 24 are anchored to a concrete foundation 36 of a house. A compressor 38 is supported on the horizontal members 26 of the angular brackets 24 and is attached thereto using screws (not shown). The wall is covered with a layer of bricks 40. A front edge 42 of the bricks 40 overhangs in front of the surface of the concrete foundation 36. Given this overhanging, attaching the angular brackets 24 on the wall could be difficult if the vertical members 28 had to overlap over both the concrete foundation 36 and the bricks 38. However, on FIG. 2, a height of the concrete foundation 36 is sufficient for mounting the angular brackets 24 such that the vertical members 28 do not reach the front edge 42 of the bricks 38 while positioning the compressor 38 at a desired height.

Mounting the angular brackets 10 or 24 on a concrete foundation forms a very rigid structure for receiving a compressor. This arrangement greatly diminishes the transmission of harmonic vibrations and of noise that could be transmitted if the compressor was instead mounted to the wall of a house.

On many houses, external walls are covered with a layer of bricks, or with other finishing material, such as vinyl siding, aluminum siding, wood panels, engineered panels such as for example CanExel® panels, and the like, that extends to a low level of the walls, providing little clearance above the concrete foundation. These finishes have a profile that usually overhangs above the front edge of the concrete foundation. When it is desired to position a compressor so that its lower end is positioned above a lower edge of the finishing material, the angular brackets 10 or 24 cannot be easily mounted on the wall. Although a bottom end of the vertical members of the angular brackets may be sufficiently low to be directly anchored to the concrete foundation, a top end of the vertical members may reach a level where the finishing material is present. One solution to this problem may be to cut into the finishing material to provide some clearance for installing the angular brackets. This is generally not perceived as a good solution at least because it is time consuming, the result may be unsightly and also because installers may be concerned about damaging electrical wiring or insulation material present behind the finishing material.

FIG. 3 (prior art) is a perspective view of a heat pump compressor mounted on specially configured brackets. A wall is covered with vinyl or aluminum siding 50 that leaves a modest visible height of concrete foundation 52 above the ground. A compressor 54 is supported by special brackets 60 that have more complex shape than the angular brackets 10 and 24. Each special bracket 60 includes a top horizontal member 62 that is arranged to be at a desired height for supporting the compressor 54. A first vertical member 64 is short and is anchored to the concrete foundation 52. A length of the first vertical member 64 must be selected so that its top comes close to the vinyl or aluminum siding 50 without any overlap. A second vertical member 66 is connected to the first vertical member 64 by a horizontal offset member 68. A length of the second vertical member 66 must be selected so that the compressor 54 is positioned at a desired height above the ground. A length of the horizontal offset member 68 must be selected to provide clearance for the second vertical member 66 in front of the vinyl siding 50. Different configurations of the various members 64, 66 and 68 may be required depending on the particular configuration of the finishing material installed on a wall.

An angled brace 70 is welded to the top horizontal member 62, the second vertical member 66, the offset horizontal member 68 and the first vertical member 64. The length, angle and welding points on the angled brace 70 will vary in view of the respective lengths of the various members 64, 66 and 68.

A plate 72 is folded along and welded to both the first vertical member 64 and the horizontal offset member 68. Anchors 74 are inserted in apertures (not shown) of the plate 72 to further solidify the special bracket 60 on the concrete foundation 52.

Comparing the angular bracket 10 and 24 with the special bracket 60, the latter is obviously much more complicated than the former. The special bracket 60 comprises many more components that must be welded together and is therefore much more expensive. Different configurations of the special bracket 60 may be required to cater for distinct applications because an amount of clearance required by the thickness of the finishing material present above the concrete foundation 52 may vary. The special bracket 60 is therefore not readily suitable for mass production.

Therefore, there is a need for improved solutions for mounting compressors on walls covered by various types of finishing materials.

SUMMARY

According to the present disclosure, there is provided a clamp, comprising a lower section and an upper section. The lower section has a generally U-shaped cross-section forming a channel extending along a first axis. The channel has a generally flat bottom and two sides extending from the bottom along a second axis perpendicular to the first axis. A plurality of openings is formed in the bottom of the channel. The upper section comprises two elongate plates extending from the two sides of the channel along the first axis. The two elongate plates are offset along the second axis from the bottom of the channel. A plurality of apertures pierced along a third axis perpendicular to the first and second axes is distributed along the first axis on each of the two elongate plates. The apertures formed in one of the two elongate plates are coaxial with corresponding apertures formed in the other one of the two elongate plates.

According to the present disclosure, there is also provided a method for mounting a compressor on a wall covered by a finishing material overhanging above a flat, solid, and vertical surface. Two of the clamps are mounted on the vertical surface so that the first axis of each channel is oriented vertically and so that a junction between the lower and upper sections of each clamp is proximate to a lower edge of the finishing material, the two clamps being at a substantially equal height on the vertical surface and at a lateral distance corresponding to a width of the compressor. A plurality of lateral apertures is pierced in vertical members of two brackets, a position of the lateral apertures being selected to match a pair of corresponding apertures on the elongate plates of the two clamps and being selected so that a horizontal member of each bracket extends away from the wall at a selected installed height of the compressor. The two brackets are attached to the two clamps by inserting a bolt through each of the lateral apertures of the vertical members of the two brackets and through each pair of corresponding apertures of the two clamps.

The present disclosure further relates to a method for mounting a bracket on a wall covered by a finishing material overhanging above a flat, solid, and vertical surface. The clamp is mounted on the vertical surface so that the first axis of the channel is oriented vertically, a junction between the lower and upper sections of the clamp being proximate to a lower edge of the finishing material. A plurality of lateral apertures is pierced in a vertical member of the bracket, a position of the lateral apertures being selected to match a pair of corresponding apertures on the elongate plates of the clamp and being selected so that a horizontal member of the bracket is at a selected height and at a selected orientation in front of the wall. The bracket is attached to the clamp by inserting a bolt through each of the lateral apertures of the vertical member of the bracket and through each pair of corresponding apertures of the clamp.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Various aspects of the present disclosure generally address one or more of the problems of mounting compressors on walls covered by various types of finishing materials.

Generally speaking a clamp (or shoe) is configured for mounting on a flat, solid and vertical surface, for example the concrete foundation of a house. The clamp has a lower section having a limited length so that its bottom can be anchored to a limited exposed height of the concrete foundation. The clamp has an upper section that extends at an offset from the bottom of the lower section to provide clearance from the finishing material covering the wall. A conventional bracket designed for supporting a compressor, for example the angular brackets 10 or 24, may be attached to the upper section of the clamp. A pair clamps and a pair of conventional brackets are installed in pairs for supporting a compressor. This does not limit the generality of the present disclosure, as a single clamp and a single bracket may be used for other applications.

In the present disclosure, the expression "along a given axis" is to be understood as synonymous with "in a direction of the given axis" and "substantially parallel to the given axis". Where an axis is characterized as being perpendicular to another axis, a variation of a few degrees from absolute perpendicularity may be accepted, inasmuch as the clamp of the present disclosure can achieve its intended purpose. The term "generally" as applied to a qualifier, for example in "generally flat", is intended to incorporate minor and inconsequential variations from the qualifier. Dimensions shown on some of the drawings are in inches. All dimensions shown and described are for illustration purposes and do not limit the present disclosure.

Figure 1:
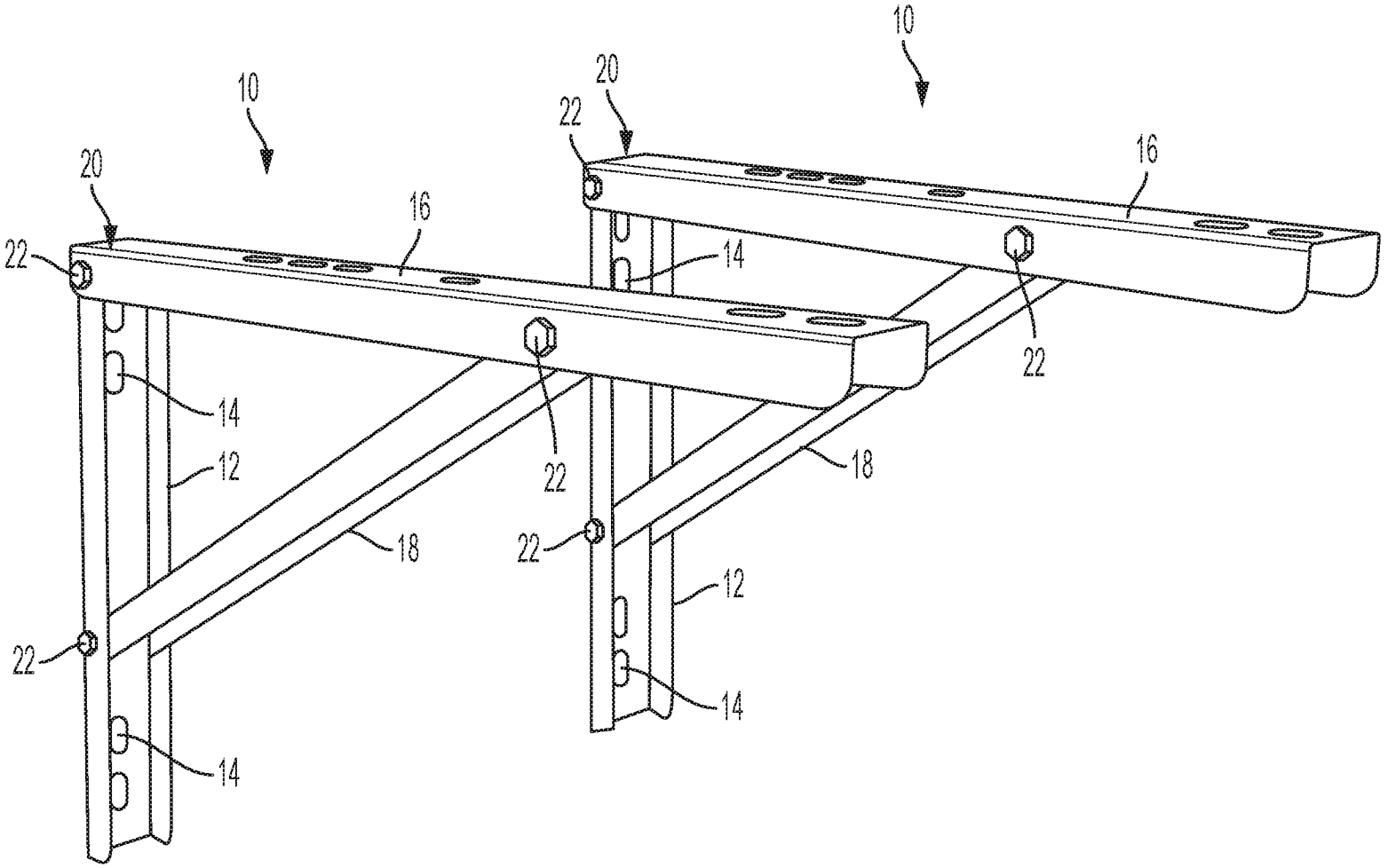
Figure 1 (Prior Art)
FIG. 1 (prior art) is a perspective view of a pair of conventional angular brackets that can be attached to a solid structure.
Figure 2:
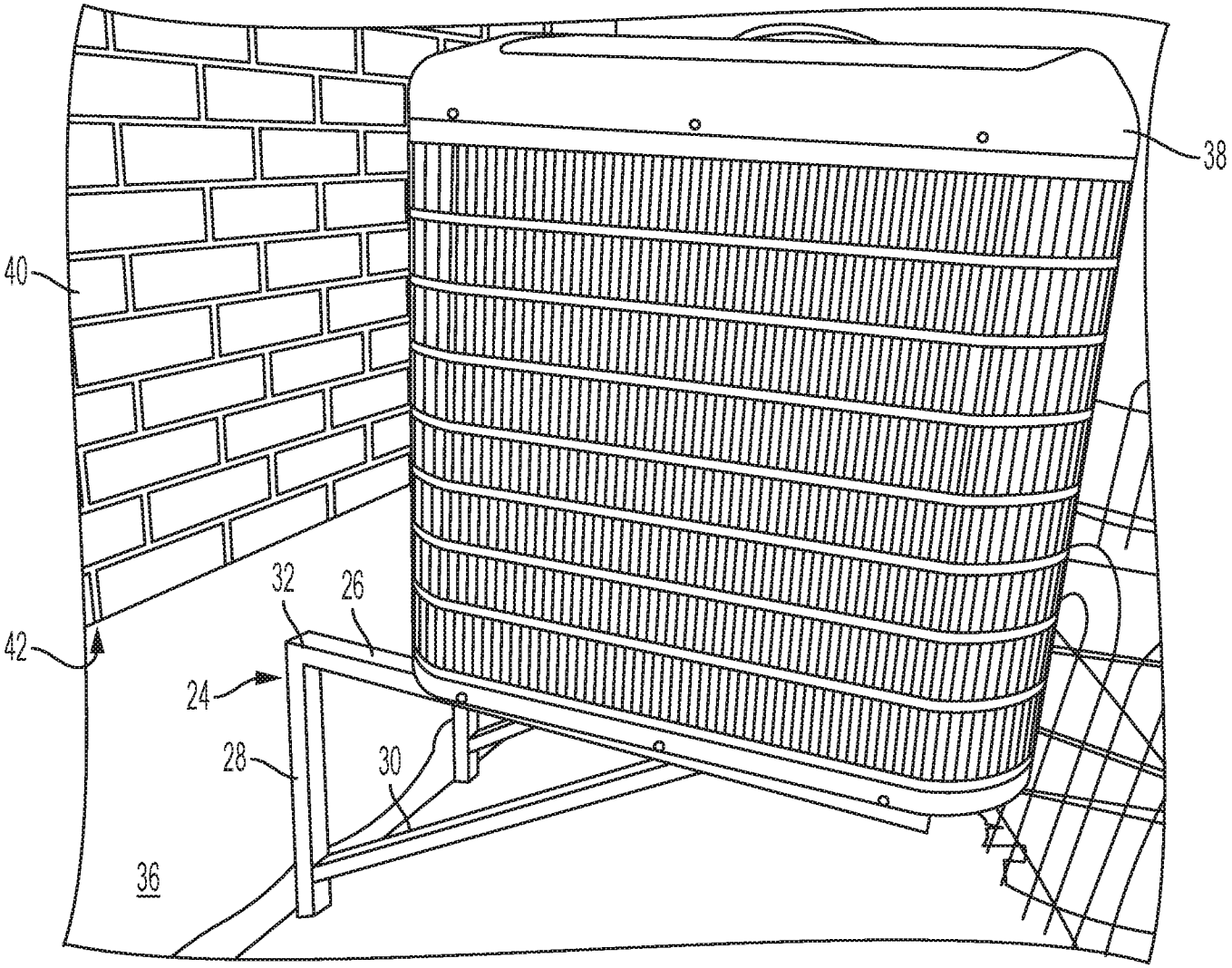
Figure 2 (Prior Art)
FIG. 2 (prior art) is a perspective view of a heat pump compressor supported by a pair of angular brackets.
Figure 3:
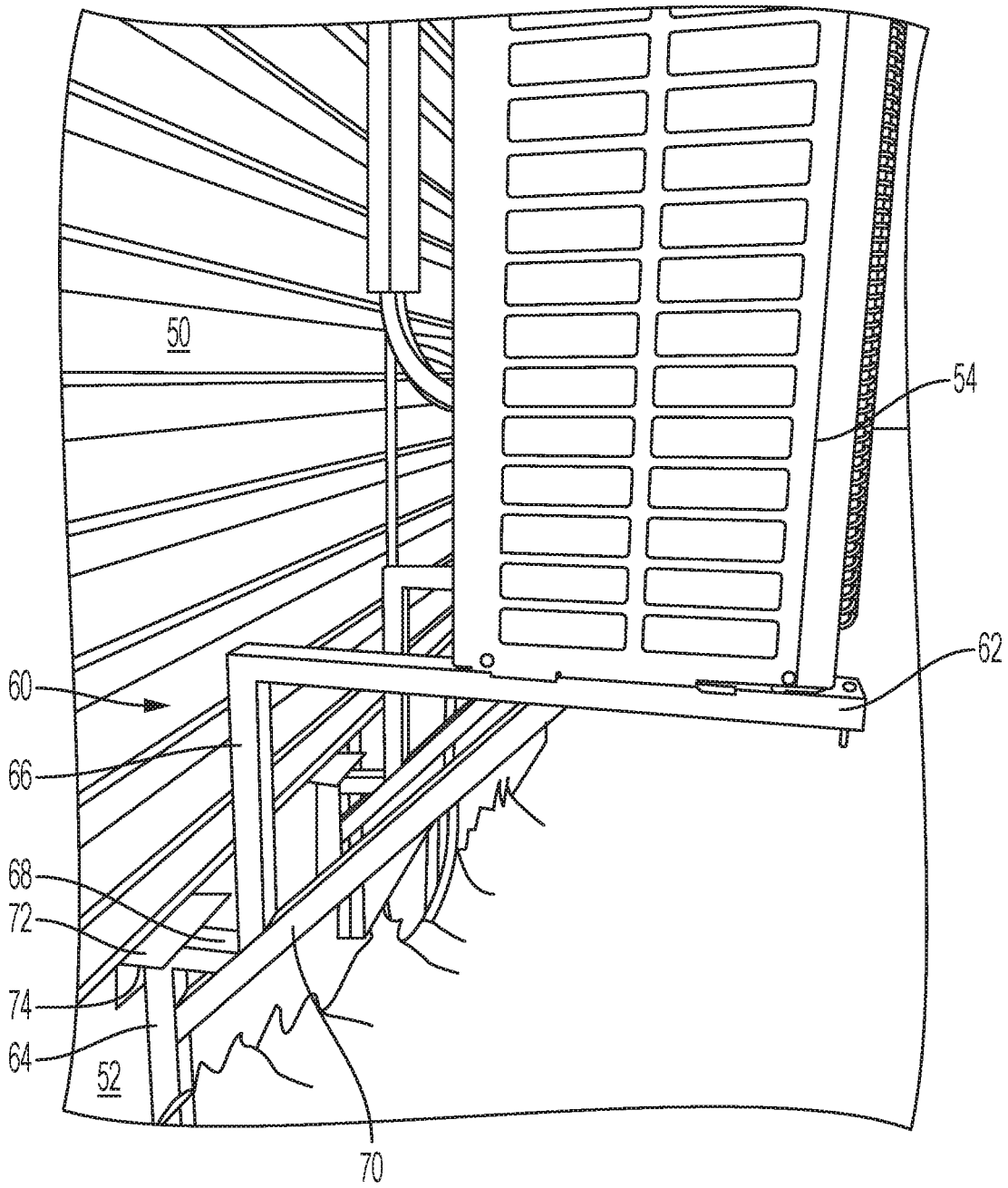
Figure 3 (Prior Art)
FIG. 3 (prior art) is a perspective view of a heat pump compressor mounted on specially configured brackets.
Figure 4:
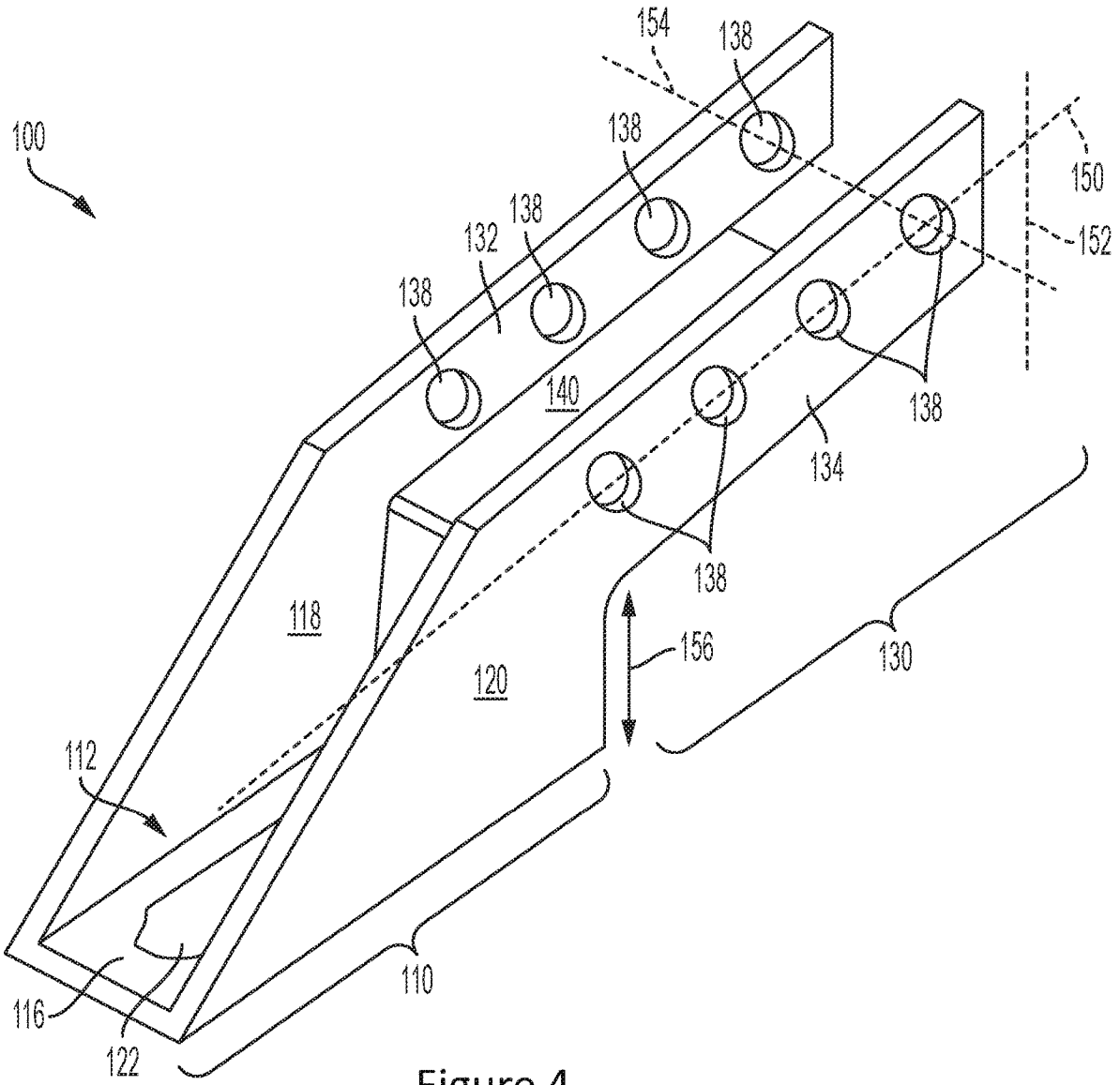
FIG. 4 is a sketch perspective view of a clamp according to an embodiment.

Referring now to the drawings, FIG. 4 is a sketch perspective view of a clamp according to an embodiment. A clamp 100 has a lower section 110 and an upper section 130. The lower section 110 has a generally U-shaped cross-section forming a channel 112 extending along a first axis 150. The channel 112 has a generally flat bottom 116 and two sides 118 and 120 that extend from the bottom 116 along a second axis 152 perpendicular to the first axis 150. A plurality of openings 122 (only one is shown on FIG. 4) are formed in the bottom of 116 the channel 112.

The upper section 130 comprises two elongate plates 132 and 134 that respectively extend from the two sides 118 and 120 of the channel 112. The two elongate plates 132 and 134 extend along the first axis 150. The two elongate plates 132 and 134 are offset along the second axis 152 from the bottom 116 of the channel 112. An extent 156 of the offset between the bottom 116 of the channel 112 and the two elongate plates 132 and 134 may vary between various implementations of the clamp 100, depending on their intended uses, as will be explained in details below. A plurality of apertures 138, for example circular apertures, is pierced in each of the elongate plates 132 and 134, the apertures 138 are pierced along a third axis 154 perpendicular to the first axis 150 and perpendicular to the second axis 152. The apertures 138 are distributed along the first axis 150 on each of the two elongate plates 132 and 134. The apertures 138 in the elongate plate 132 are coaxial with corresponding apertures 148 formed in the elongate plate 144.

In the illustrated embodiment of FIG. 4, a width of the channel 112 is equal to a lateral distance between the two elongate plates 132 and 134, this lateral distance being for example in a range between 1.5 and 1.6 inches, which conforms with dimensions of members of many conventional angular brackets. In the same or another embodiment, the apertures 148 are sized for receiving galvanized or stainless steel crossing bolts (not shown). A diameter of these bolts may vary between 0.25 and 0.50 inch, depending on the weight of the compressor that will be supported by the clamp 100.

The clamp 100 has a bottom 140 of the upper section 130. The bottom 140 extends along the first axis 150 between the two elongate plates 132 and 134. The bottom 140 is also offset along the second axis 140 from the bottom 116 of the channel 112.

The clamp 100 may be formed of a unitary piece of metal, for example and without limitation from aluminum, stainless steel, galvanized steel, and the like.

Figure 5:
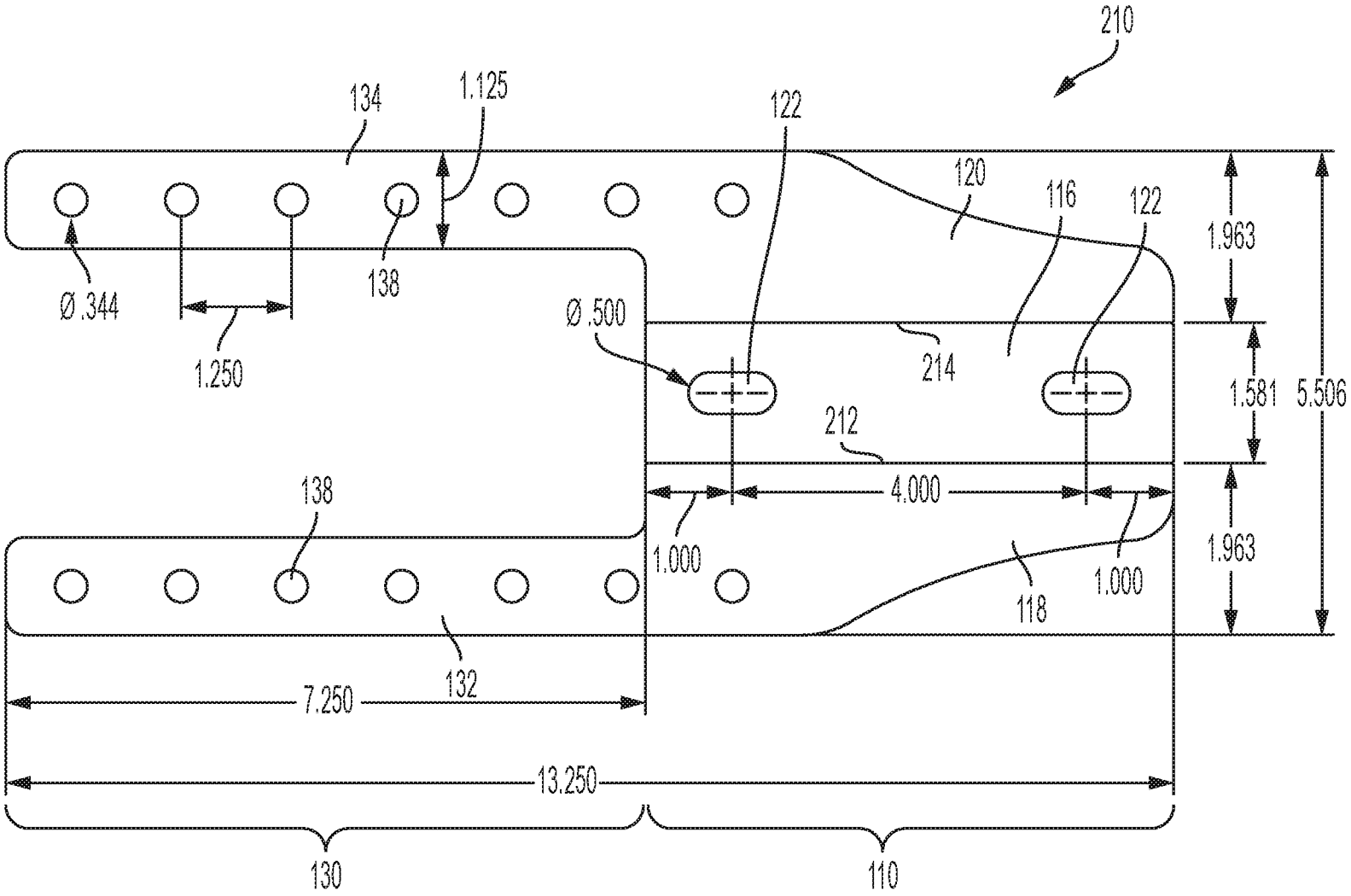
FIG. 5 is a top elevation view of a precut sheet of metal according to another embodiment.

FIG. 5 is a top elevation view of a precut sheet of metal according to another embodiment. In this embodiment, a clamp 200 (FIGS. 6 and 7) may be formed by folding a precut sheet 210 made of aluminum or another metal. The precut sheet 210 comprises many elements of the clamp 100, except that the bottom 140 of the upper section 130 is absent in the particular and non-limiting embodiment of FIG. 5. A variant of the precut sheet may include a section that can be folded to form the bottom 140 of the upper section 130.

As shown, two openings 122 are formed in the bottom 116, the two openings 122 having an obround shape. It is contemplated that other opening shapes and other numbers of openings 122 may be formed in the bottom 116.

Ridges 212 and 214 are pre-formed within the lower section 110 to facilitate folding of the precut sheet 210. Folding the precut sheet 210 about the ridges 212 and 214 to bring the sides 118 and 120 in parallel allows to create of the channel 112 (FIG. 4) while also bringing the elongate plates 132 and 134 in parallel and completing the forming of the clamp 200.

Figure 7:
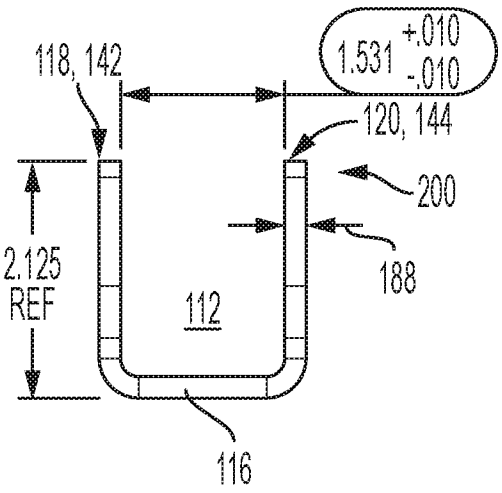
FIG. 7 is a front elevation view of the clamp of FIG. 6.
Figure 6:
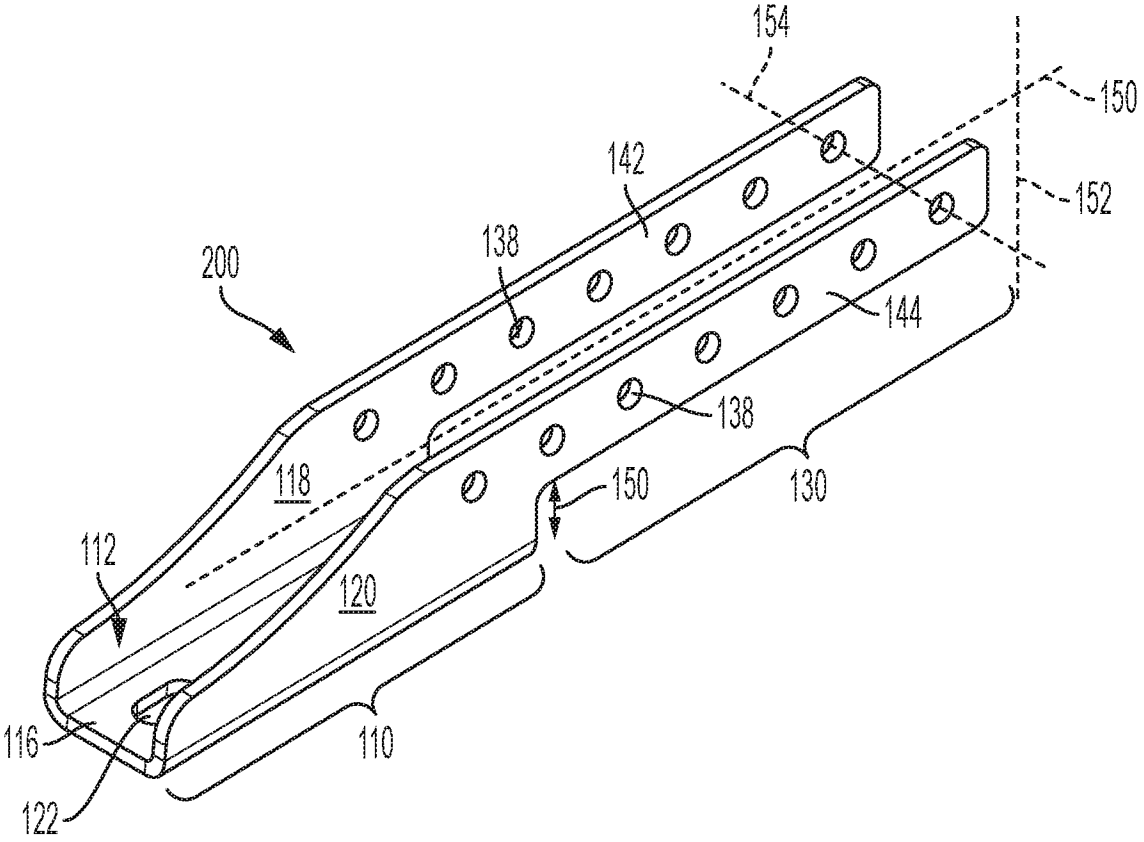
FIG. 6 is a perspective view of a clamp obtained by folding the precut sheet of metal of FIG. 5.

FIG. 6 is a perspective view of a clamp obtained by folding the precut sheet of metal of FIG. 5. FIG. 7 is a front elevation view of the clamp of FIG. 6. The clamp 200 differs from the clamp 100 in that in does not include the bottom 140 of the upper section 130, in that relative dimensions of its parts are different, and in that it includes a greater number of apertures 138. It is otherwise similar and can be used in the same manner.

Figure 8:
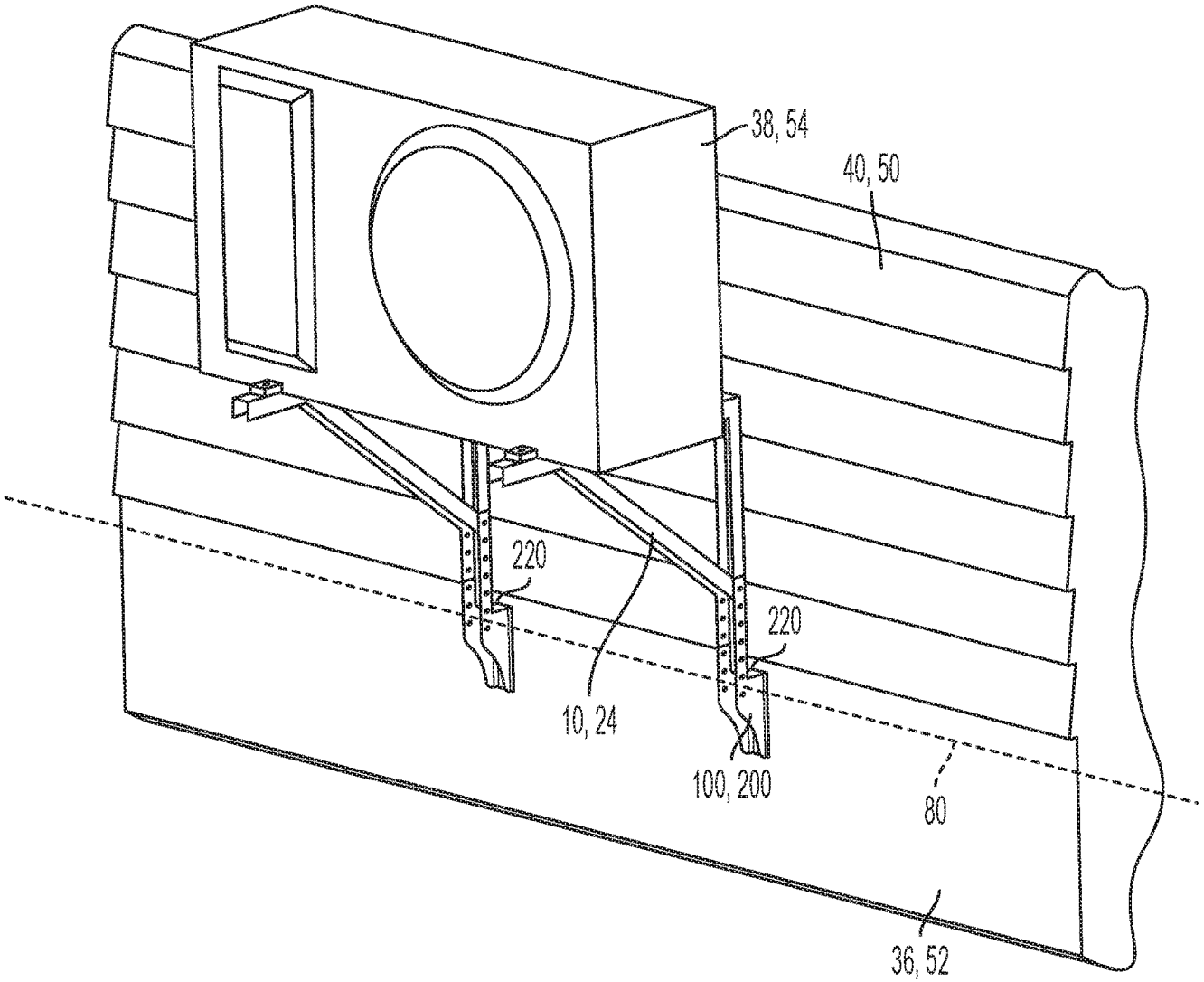
FIG. 8 is a perspective view of a compressor mounted on a wall using the clamp of FIG. 4 or 6.

FIG. 8 is a perspective view of a compressor mounted on a wall using the clamp of FIG. 4 or 6. A compressor 38 or 54 is supported in front of a wall covered by a layer of bricks 40 or by aluminum or vinyl siding 50. Two clamps 100 or 200 are anchored to a concrete foundation 36 or 52 so that a junction 220 between the lower section 110 and the upper section 130 of each clamp 100 or 200 is positioned near a bottom of the bricks 40 or of the siding 50, without overlapping thereon. As illustrated, the bricks 40 or siding 50 extends almost to ground level 80 so the lower section 110 extends in part under the ground level 80. Positioning a part of the lower section 110 in the ground may not be necessary, depending on a distance between the ground level 80 and the lower edge of the bricks 40 or siding. The clamps 100 or 200 may have been selected among several sets of clamps 100 or 200. Distinct sets of clamps 100 or 200 may have different extents 156 of the offset between the bottom 116 of the channel 112 and the two elongate plates 132 and 134. The particular clamps 100 or 200 shown on FIG. 8 may thus have been selected to provide clearance between the upper sections 130 of the clamps 100 or 200 and the bricks 40 or the siding 50.

Two angular brackets 10 or 24 are attached on the clamps 100 or 200. The angular brackets 10 or 24 are clear of the bricks 40 or siding 50 given that their vertical members 12 or 66 are inserted between the elongated plates 132 and 134 of each clamp 100 or 200, the elongated plates 132 and 134 being themselves clear of the bricks 40 or siding 50.

Mounting a compressor on a wall covered by a finishing material overhanging above a flat, solid, and vertical surface may be performed using the following operations.

The clamps 100 or 200 may be available as a plurality of sets of clamps 100 or 200, the clamps 100 or 200 of each set having a specific offset 156 between their elongate plates 132 and 134 and the bottoms 116 of their channels 112. If several sets of clamps 100 or 200 are available, two clamps 100 or 200 may be selected so that the offset 156 between their two elongate plates 132 and 134 and the bottom 116 of the channel 112 of each clamp 100 or 200 is sufficient to clear the two elongate plates 132 and 134 from the finishing material, for example the bricks 40 or the siding 50.

Various sets of clamps 100 or 200 may also have various lateral distances between the elongate plates 132 and 134. The two clamps 100 or 200 may be selected so that a lateral distance between their elongate plates 132 and 134 matches an external width of the vertical members 12 or 28 of a selected pair of brackets 10 or 24.

The two clamps 100 or 200 are mounted on the vertical surface, for example the concrete foundation 36 or 52, so that the first axis 150 of each channel 112 is oriented vertically. The two clamps 100 or 200 may be mounted on the vertical surface by inserting anchors (not shown) through at least two openings 122 formed in the bottom 116 of each channel 112 and through bores provided in the vertical surface. The junction 220 between the lower sections 110 and the upper sections 130 of each clamp 100 or 200 should be placed proximate to a lower edge of the finishing material such as the bricks 40 or the siding 50. The two clamps 100 or 200 are positioned on the vertical surface at a substantially equal height on the vertical surface and at a lateral distance corresponding to a width of the compressor 38 or 54. This lateral distance is not necessarily the overall width of the compressor 38 or 54, but is selected to correspond to mounting holes (not shown) that are usually preformed on a base of the compressor 38 or 54.

Two brackets 10 or 24 are selected. Several lateral apertures are pierced in the vertical members 12 or 28 of two brackets 10 or 24. A position of the lateral apertures are selected to match a pair of corresponding apertures 138 on the elongate plates 132 and 134 of the two clamps 100 or 200. The position of the lateral apertures pierced in the vertical members 12 or 28 is also selected so that the horizontal member 16 or 26 of each bracket 10 or 24 extends away from the wall, at a selected installed height of the compressor 38 or 54. The two brackets 10 or 24 are then attached to the two clamps 10 or 24 by inserting a bolt (not shown) through each of the lateral apertures of the vertical members 12 or 28 of the two brackets 10 or 24 and through each pair of corresponding apertures 138 of the two clamps 100 or 200. In the particular case of the clamps 100 in which the upper sections 130 include the bottoms 140 extending between the two elongate plates 132 and 134, a rear face of the vertical member 12 or 28 of each bracket 10 or 24 may be positioned against the bottom 140.

The compressor 38 or 54 may then be placed on top of the horizontal members 16 or 26 of the two brackets 10 or 24. The compressor 38 or 54 may be attached to the horizontal members 16 or 26 of the two brackets 10 or 24 using screws (not shown).

Other uses of the clamps 100 or 200 are also contemplated. For example, a single bracket 10 or 24 or a differently shaped bracket may be mounted on a wall covered by a finishing material overhanging above a flat, solid, and vertical surface. The clamp 100 or 200 may be mounted on the vertical surface so that the first axis 150 of the channel 112 is oriented vertically and so that the junction 220 between the lower section 110 and the upper section 130 of the clamp 100 or 200 is proximate to a lower edge of the finishing material. Lateral apertures (not shown) are pierced in a vertical member 10 or 28 of the bracket 10 or 24, a position of the lateral apertures being selected to match a pair of corresponding apertures 138 on the elongate plates 132 and 134 of the clamp 100 or 200 and being selected so that a horizontal member 16 or 26 of the bracket 10 or 24 is at a selected height and at a selected orientation in front of the wall. It may be desired to place the horizontal member 16 or 26 parallel to the finishing material of the wall; this is possible when a single clamp 100 or 200 and a single bracket 10 or 24 are mounted on a wall for other applications.

The bracket 10 or 24 is attached to the clamp 100 or 200 by inserting a bolt (not shown) through each of the lateral apertures of the vertical member 12 or 28 of the bracket 10 or 24 and through each pair of corresponding apertures 138 of the clamp 100 or 200.

Some of the above described operations may possibly be executed in a different order or executed concurrently, and some of the operations may be optional.

Those of ordinary skill in the art will realize that the description of the clamp and method of using the clamp for mounting a compressor on a wall are illustrative only and are not intended to be in any way limiting. Other embodiments will readily suggest themselves to such persons with ordinary skill in the art having the benefit of the present disclosure. Furthermore, the disclosed clamp and method may be customized to offer valuable solutions to existing needs and problems related to mounting compressors on walls. In the interest of clarity, not all of the routine features of the implementations of the clamp and method are shown and described. In particular, combinations of features are not limited to those presented in the foregoing description as combinations of elements listed in the appended claims form an integral part of the present disclosure. It will, of course, be appreciated that in the development of any such actual implementation of the clamp and method, numerous implementation-specific decisions may need to be made in order to achieve the developer's specific goals, such as compliance with application-related and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of mounting hardware having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A clamp, comprising:

a lower section having a generally U-shaped cross-section forming a channel extending along a first axis, the channel having a generally flat bottom and two sides extending from the bottom along a second axis perpendicular to the first axis, a plurality of openings being formed in the bottom of the channel; and an upper section comprising two elongate plates extending from the two sides of the channel along the first axis, the two elongate plates being offset along the second axis from the bottom of the channel, a plurality of apertures pierced along a third axis perpendicular to the first and second axes being distributed along the first axis on each of the two elongate plates, the apertures formed in one of the two elongate plates being coaxial with corresponding apertures formed in the other one of the two elongate plates.

2. The clamp of claim 1, further comprising a bottom of the upper section extending along the first axis between the two elongate plates, the bottom of the upper section being offset along the second axis from the bottom of the channel.

3. The clamp of claim 1, wherein the clamp is formed of a precut and folded sheet of metal.

4. The clamp of claim 1, wherein a width of the channel is equal to a lateral distance between the two elongate plates.

5. The clamp of claim 4, wherein the width of the channel is in a range between 1.5 and 1.6 inches.

6. The clamp of claim 1, wherein the plurality of openings formed in the bottom of the channel comprises two openings, at least one of the two openings being an obround opening.

7. The clamp of claim 1, wherein the plurality of apertures distributed along the first axis on each of the two elongate plates are circular apertures.

8. The clamp of claim 7, wherein the circular apertures are sized for receiving bolts having a diameter between 0.25 and 0.5 inch.

9. A method for mounting a compressor on a wall covered by a finishing material overhanging above a flat, solid, and vertical surface, comprising:

mounting two clamps as defined in claim 1 on the vertical surface so that the first axis of each channel is oriented vertically, a junction between the lower and upper sections of each clamp being proximate to a lower edge of the finishing material, the two clamps being at a substantially equal height on the vertical surface and at a lateral distance corresponding to a width of the compressor;

piercing a plurality of lateral apertures in vertical members of two brackets, a position of the lateral apertures being selected to match a pair of corresponding apertures on the elongate plates of the two clamps and being selected so that a horizontal member of each bracket extends away from the wall at a selected installed height of the compressor; and attaching the two brackets to the two clamps by inserting a bolt through each of the lateral apertures of the vertical members of the two brackets and through each pair of corresponding apertures of the two clamps.

10. The method of claim 9, further comprising selecting the two clamps so that the offset between the two elongate plates and the bottom of the channel of each clamp is sufficient to clear the two elongate plates from the finishing material.

11. The method of claim 10, wherein the two clamps are selected among a plurality of clamps, the plurality of clamps including a plurality of sets of clamps, the clamps of each set having a specific offset between their elongate plates and the bottoms of their channels.

12. The method of claim 9, further comprising selecting the two clamps so that a lateral distance between the two elongate plates matches an external width of the vertical members of the brackets.

13. The method of claim 9, wherein the two clamps each comprise a bottom of the upper section extending along the first axis and connecting the two elongate plates, the bottom of the upper section being offset along the second axis from the bottom of the channel, the method further comprising positioning a rear face of the vertical member of each bracket against the bottom of the upper section of the corresponding clamp.

14. The method of claim 9, wherein mounting the two clamps on the vertical surface comprises inserting anchors through at least two of the plurality of openings formed in the bottom of each channel and through bores provided in the vertical surface.

15. The method of claim 9, further comprising:

placing the compressor on top of the horizontal members of the two brackets; and attaching the compressor to the horizontal members of the two brackets using screws.

16. A method for mounting a bracket on a wall covered by a finishing material overhanging above a flat, solid, and vertical surface, comprising:

mounting a clamp as defined in claim 1 on the vertical surface so that the first axis of the channel is oriented vertically, a junction between the lower and upper sections of the clamp being proximate to a lower edge of the finishing material;

piercing a plurality of lateral apertures in a vertical member of the bracket, a position of the lateral apertures being selected to match a pair of corresponding apertures on the elongate plates of the clamp and being selected so that a horizontal member of the bracket is at a selected height and at a selected orientation in front of the wall; and attaching the bracket to the clamp by inserting a bolt through each of the lateral apertures of the vertical member of the bracket and through each pair of corresponding apertures of the clamp.

* * * * *